United States Patent [19]

Nomura et al.

[11] 3,960,681

[45] June 1, 1976

[54] METHOD FOR PRODUCING ELECTROLYTIC HIGH PURITY LEAD USING LARGE-SIZED ELECTRODES

[75] Inventors: Etsuji Nomura, Tokyo; Masaharu Aramaki, Takehara; Yuji Nishimura, Omuta, all of Japan

[73] Assignee: Mitsui Mining & Smelting Co., Ltd., Tokyo, Japan

[22] Filed: Jan. 29, 1975

[21] Appl. No.: 545,125

[30] Foreign Application Priority Data

Feb. 21, 1974 Japan ..... 49-20838
Feb. 22, 1974 Japan ..... 49-21164

[52] U.S. Cl. ..... 204/114; 204/293
[51] Int. Cl.[2] ..... C25C 1/18; C25B 11/04
[58] Field of Search ..... 204/114, 293

[56] References Cited

OTHER PUBLICATIONS

Electrochem. Eng., C. L. Mantell, 4th Ed., 1960, pp. 188–192.

*Primary Examiner*—R. L. Andrews
*Attorney, Agent, or Firm*—Armstrong, Nikaido & Wegner

[57] ABSTRACT

Betts process for electrolytically refining lead from crude lead containing bismuth is improved by the use of crude lead anodes containing as impurities 0.8 to 1.3 % by weight of antimony, 0.6 % by weight or less of bismuth, 0.1 % by weight or less of copper and 0.05 % by weight or less of tin, the ratio of the sum of the contents of antimony and arsenic to the content of bismuth being 2.0 or more, whereby producing electrolytically deposited lead which is feasible for being refined into a purity of 99.999 % or more when being subjected to the Harris process. The Betts process can be effected in a large-sized electrolytic cel containing corresponding electrodes by the use of high purity lead cathodes having at the centers many wrinkles capable of absorbing residual strain.

5 Claims, 4 Drawing Figures

METHOD FOR PRODUCING ELECTROLYTIC HIGH PURITY LEAD USING LARGE-SIZED ELECTRODES

This invention relates to an improvement of the electrolytic production of lead according to the so-called Betts process, and particularly it concerns the developement for obtaining lead which is feasible for being refined into a purity of 99.999 % or more in the Harris process.

For the refining of pyrometallurgical lead bullions containing no Bi, there is generally adopted a pyrometallurgical refining process. However, lead bullion containing bismuth (Bi) can be difficultly refined by the pyrometallurgical process, and hence is usually treated according to the so-called Betts process in which anode plates made of lead bullions and cathode plates made of high purity lead which has ordinarily been obtained by electrolytic deposition, are suspended in an electrolyte comprising an aqueous solution of lead hexafluorosilicate and hexafluorosilicic acid, a direct current is applied to the electrodes thereby depositing on the cathode plates the lead contained in the crude lead anode plates and, at the same time, retaining as anode slimes other impurities contained in the anode plates, and then the resulting metal lead is recovered and the electrolyte is recycled.

In the conventional refining of crude lead according to the Betts process, refined metal lead has been obtained in such a manner that in a wooden or concrete-made electrolytic cell lined with asphalt which is 2 to 3 m. in length, about 700 to 800 mm. in width, about 1 m. in depth and about 1.4 to 2.4 $m^3$ in volume, at most about 20 anode plates each having a thickness of about 30 mm. and about 21 cathode plates each having a thickness of about 1 mm., are alternately arranged at anodes intervals of about 100 mm. and suspended in an electrolyte comprising an aqueous solution containing 50 to 125 g/l of lead (Pb), 60 to 100 g/l of free $H_2SiF_6$ and 100 to 175 g/l of total $H_2SiF_6$, the said electrolyte being maintained at normal temperature and having been incorporated with glue and/or a pulp waste liquor, thereafter a current is applied to a density of 100 to 165 $A/m^2$, and the cathode plates are taken up every 3 to 5 days while the anode plates every 6 to 10 days, i.e. twice the taking-up times of the cathode plates. In the above case, the current efficiency is 90 to 93 %, and the purity of the metal lead obtained is 99.95 to 99.97 %. Subsequently, the electrodeposited lead thus obtained is further subjected to the so-called Harris process in which the lead is melted in the presence of sodium hydroxide to remove trace amounts of arsenic, antimony, tin, zinc and the like impurities present therein, whereby high purity lead is obtained. However, according to the conventional method described above, it has been difficult to obtain lead having a 99.999 % purity.

Originally, the Betts process has such disadvantage as being relatively high in refining cost as compared with the pyrometallurgical process. As a measure for overcoming the said disadvantage, it is necessary that the electrolytic cell should be made larger in size without degrading the current efficiency. In processing the electrolytic cell larger in size, however, there is encountered the difficulty that the distance between the two electrodes cannot be maintained properly. That is, the surface distance between the two electrodes is only 3 to 4 cm. even at the initial stage of electrolysis. Accordingly, if the electrode plates are deformed, the current distribution becomes not uniform, and even short circuit occurs in extreme cases, with the result that the current efficiency is markedly decreased. The said deformation becomes greater with increasing size of electrode plates. Particularly, high purity lead plates used as the cathodes are conveniently produced in large quantities on commercial scale by cutting an endless lead sheet prepared by casting molten lead on a rotating drum, and then peeling and winding up the resulting sheet. Even when press-molded, therefore, the cathode plates tend to cause deformation due to residual strain at the time when they are suspended in an electrolytic cell. On the other hand, the anode plates, which are cast by pouring molten crude lead into casting molds, tend to bend with increasing size, though various considerations have been made as to the conditions of the casting temperature, the casting method, the cooling temperature, etc. Further, due to insufficient mechanical strength inherent to lead itself, the electrodes are deformed at the time of transportation, installation and the like disposition during the period raging from the taking-out thereof from the molds to the suspension thereof in the electrolytic cell, with the result that much labor is required for the rectification of said deformation.

When electrolysis is effected according to the prior art process by use of cathodes prepared by press-shaping the plates cut from an endless sheet into a large size of, for example, 108 cm. in width, 130 cm. in length and 1 mm. in thickness which is larger in size than in the prior art, and anodes prepared according to an ordinary procedure and somewhat smaller than the cathode plates, the deviation of the cathode plates from the cathode beams reaches as great as 20 mm. and the current efficiency is not more than at most 60 to 80 %. In order to increase the current efficiency in the above case, the cathode plates should frequently be taken up to rectify the deformation to bring about such disadvantages that not only much labor is required for the rectification but also the electrolyte is undesirably contaminated due to stripping of anode slimes.

An object of the present invention is to provide an improvement of the Betts process for preparing refined lead which is feasible to be refined into a purity of 99.999 % or more in the subsequent Harris process.

Another object of the invention is to provide an improvement of the Betts process for enlarging the capacity of electrolytic cell.

The first object can be accomplished according to the present invention by an improvement in the electrolytical production of lead according to the Betts process, which comprises using the anodes of crude lead containing as impurites 0.8 to 1.3 wt % of antimony, 0.6 wt % or less of bismuth, 0.1 wt % or less of copper and 0.05 wt % or less of tin, the ratio of the sum of the contents of antimony and arsenic to the content of bismuth being 2.0 or more, whereby producing electrolytically deposited lead feasible for being refined into a purity of 99.999 % or more in the Harris process.

The second object of the invention can be accomplished according to the present invention by use of the electrodes larger than in the prior art, the deviations of the cathode and anode plates from each electrode beam being 5 mm. or less and 3 mm. or less, respectively.

In order to accomplish the above-mentioned objects, the present inventors extensively examined and studied the phenomenon and cause of impurification of lead electrodeposited by the Betts process to find that the impurification is ascribable chiefly to the physical properties of slimes formed on the anodes during electrolysis, and that it can be inhibited by regulating the ranges of contents of certain metal impurities constituting the slimes. That is, the inventors have found that for prevention of said impurification, it is important that the anode slimes are always adhered as a spongy structure to the anodes until the electrolysis is terminated. It may be said that the quality of said slime structure dominates the electrolytical and mechanical contamination of the resulting lead. If the slime structure is too coarse, the slimes are stripped off during the electrolysis to mechanically contaminate the lead deposited on the cathodes, while if the slime structure is excessively dense, the dissolving-out of lead from the anodes is disturbed, whereby the concentration of lead in the slime layer increases to an extraordinary extent to increase the electrolytic bath voltage, with the result that Sb, Bi and the like metals which are nobler than lead are electritically dissolved, and these metals, migrate into the electrodeposited lead.

Generally, anode slime structure becomes too coarse if the amounts of impurities in the anode plates are excessively small, and becomes dense if the amounts of impurities are large. Thus, a slime structure which is coarse and tough is most preferable. In order to obtain high purity lead by electrolysis, therefore, it is important to examine the composition of anodes. The present inventors have prepared various lead bullion materials for anode according to several known processes using each of blast furnace, short rotary furnace, fuming furnace, and simultaneous lead-zinc smelting furnace (I.S.F.), and subjecting the lead bullion materials to known copper-removing treatment and to tin- and arsenic-removing treatments according to the Harris process. In combination of some of the lead bullion materials, the inventors have found that lead containing specific impurities in specific amounts gives a suitable anode for forming spongy structure which is coarse and tough, and that the Betts process using the anodes gives a high purity of deposited lead which can further be refined by the Harris process to remove Zn, As, Sn, Sb and other metals into extremely high purity lead having a purity of 99.999 % or more.

The lead bullion material used as anodes in the present method contains 0.1 wt % or less of Cu, 0.6 wt % or less of Bi and 0.8 to 1.3 wt % of Sb, and has an (Sb + As)/Bi ratio of more than 2. When migrated into the electrodeposited lead, Bi and Cu among the metals contained as impurities are difficultly removable by refining according to the Harris process. Accordingly, the crude lead for the anodes should have been decreased in content of said metals to the above-mentioned limits. When the anode composition is thus controlled, and when Bi and Cu in the electrolyte are further removed, the amounts of Bi and Cu in the electrodeposited lead can be reduced according to the present method to less than 5 p.p.m. and 2 p.p.m., respectively. On the other hand, Sb, As and Sn, even when these have migrated into the electrodeposited lead, are easily removable at the time of the refining. Furthermore, the incorporation of some amounts of said metals into the crude lead is rather necessary to prevent the anode plates from deformation and to reinforce the structure of slimes formed on the anodes during electrolysis. Slimes formed during electrolysis on anode plates containing 0.8 to 1.3 wt % of Sb are in the form of coarse spongy structure and have firmly adhered onto the anodes, so that they are not so stripped off into the electrolyte as to greatly contaminate the electrodeposited lead on the cathodes, and the metals in the slime do not dissolve out into the electrolyte. If the content of Sb is less than 0.8 wt %, the slimes become too coarse, while if the content of Sb is more than 1.3 wt %, the slimes become excessively dense in sponge structure to increase the bath voltage, with the result that electrical dissolution of impurity metals is brought about. The presence of Sb in such amount as defined above increases the mechanical strength of lead anode plates, and can prevent the curvature of anode plates due to residual strain thereof at the time of casting. Further, it has experimentally been found that favorable results can be obtained when the amount of Bi contained in the anode plates is less than one-half the amount of Sb + As.

According to the present invention, the amounts of Sb + Sn and As in the electrodeposited lead are less than 100 and 5 p.p.m., respectively, and can individually be reduced to less than 2 p.p.m. by subjecting the lead to subsequent refining according to the Harris process.

The anode plates used in the present invention are prepared by melting a mixture comprising proper amounts of lead bullion materials having various compositions which have been smelted according to the aforesaid pyrometallurgical processes, removing the formed dross from the molten mixture, removing from the resulting crude lead, if necessary, Cu and the like metal by oxidation and Sn, As, Zn and the like metal by Harris process, to control the amount of each metal component to a predetermined amount, melting some of the thus obtained crude leads in combination, and then casting the molten crude lead to definite size and thickness.

In casting the anode plates used in the present invention, the process disclosed in U.S. patent application Ser. No. 442,575, Australian Patent Application No. 65678/74 or Canadian Patent Application No. 192251 may advantageously be employed to prevent the resulting anode plates from bending. According to the said process, the molten lead is cast into a mold at a temperature of 340° to 350°C. through trough equippted with baffle plates having many openings, which plates are located at the melt inlet and in the way from a melting kettle, and subsequently, water-cooling treatment is applied to the surface of the melt in the mold and then to the back of the mold. For commercial purpose, a turn table type mold is ordinarily used. When the above-mentioned process is adopted, not only the curved degree of the resulting anode plates becomes 3 mm. or less to anode beams but also the formation of uneven melt surface due to waving of the melt in the mold and the elevation of the melt near the mold edge are inhibited to make it possible to obtain anode plates uniform in thickness.

The high purity lead cathode plates used in the present invention may be prepared by casting the electrodeposited lead in a mold, but are desirably produced in large quantity by the so-called drum-casting in which the molten lead is spread and solidified on a rotating drum, and the resulting sheet is peeled off from the drum and then cut into a desired size. In the cast-molding, an endless sheet of lead can advantageously be obtained by adoption of the casting apparatus and method disclosed in U.S. patent application Ser. No. 443,636 Canadian Patent Application No. 192811, or Australian Patent Application No. 65829/74. The application discloses a method for continuously manufacturing an endless lead sheet from which a cathode starting sheet to be used in electrolytic refining of lead is prepared. In the method, the molten lead is cast into a thin sheet by means of a rotary casting drum in such a manner that it is continutously introduced into a first separation zone where dross is caused to come up to the surface and separated from the molten lead, a mixture of the dross and the molten lead in the vicinity of the melt surface is introduced into a second separation zone through a wide flow path, and the molten lead substantially free from the dross is introduced into a casting zone containing the rotary drum while the dross is accumulated on the liquid surface in the second separation zone, and the cast sheet on the drum is stripped off and wound up. The application discloses also an apparatus therefor in which there is provided in a casting tank a dish surrounding a bottom of a rotary cooling drum, which dish includes a laterally extending shallow cutout at an upper end thereof, and an adjustable gate device is provided between the cutout and the bottom of the drum. At the time of winding, the endless sheet is wound around a winding roll together with a flexible wire so that hill-like curves having a width of one-third to one-fourth of the width of the sheet and a height of 1/50 to 1/100 of the width of the sheet may be formed at the width-wise central portions in the length-wise direction of the sheet, whereby the winding as well as unwinding operations are facilitated. The thus prepared sheet is then cut and pressed into cathode plates. In this case, many surface wrinkles corresponding to the curved portions of the sheets are formed in the width-wise direction of the plates. Accordingly, the residual strain produced at the time of casting is absorbed in the wrinkles, so that the cathode plates are scarcely deformed even when suspended in an electrolytic cell, and the deviation degree of the cathode plates during use becomes within 5 mm. with respect to the cathode beam. This, coupled with the aforesaid effect of prevention of the anode plates from bending, results in such advantage that not only the current efficiency during electrolysis can be increased to more than 95 %, but also the stripping of slimes due to short circuit and the contamination of electrodeposited lead with slimes can be dismissed.

In the accompanying drawings, FIG. 1 is a cross-sectional view of a part of the endless sheet having hill-like curves in the length-wise direction which is before pressing;

Figure 1:
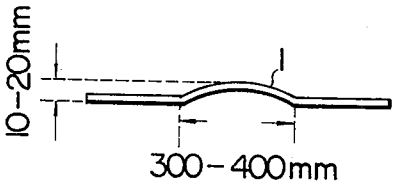
Figure 2:
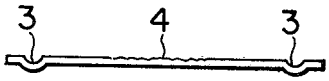
FIG. 2 is a cross-sectional view of a cathode lead plate obtained by pressing and cutting the sheet of FIG. 1.
Figure 3:
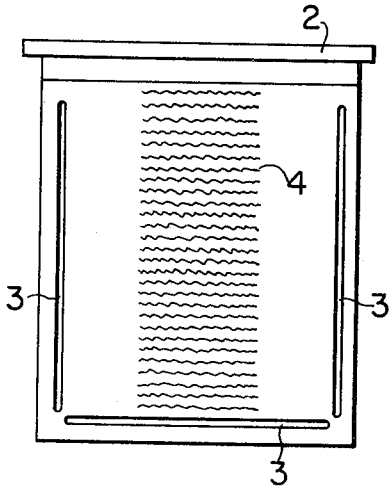
FIG. 3 is a plane view of the cathode lead plate shown in FIG. 2.

The endless sheet prepared according to the present invention may be 108 cm. in width, 119 cm. in length and 1 mm. in thickness, and, as shown in FIG. 1, have hill-like curves having a width of 30 to 40 cm. and a height of 10 to 20 mm. This sheet is then pressed by means of a press having extrusions at both edges and the bottom. When thus provided with extrusions at both edges, the press can give to the sheet many width-wise wrinkles on one side at the center thereof. As seen in FIG. 3, which is a plane view of the cathode plate attached to a cathode beam 2, the cathode plate has dents 3 at both edges and at the bottom and many wrinkles 4 at the center.

When cathodes and anodes are thus minimized in deformation, many large-sized electrodes suitable for use in an electrolytic cell larger in size than the conventional cell may be suspended, whereby lead higher in purity than in the prior art process can be obtained with high efficiency. For example, refined lead having a purity of 99.999 % can be obtained by suspending in an electrolytic cell 43 cathode plates and 42 anode plates of the sizes suitable for use in a cell of 130 cm. in width, 5 m. in length and 150 cm. in depth to form electrodeposited lead with a current efficiency of more than 95 %, and further refining the said lead by the Harris process.

Another characteristic of the present method is that the electrolyte is purified at the time of recycle. Although the contact of slimes and dissolved bismuth, copper and the like metal with the electrodeposited lead is maintained minimum according to the present invention, impurities come to accumulate in the recycle electrolyte by continuing the electrolysis. In the present invention, the recycle electrolyte is purified according to the process disclosed in, for example, United States patent application No. 443,634, Canadian Patent Application No. 192810 or Australian Patent Application No. 65830/74. That is, an electrolyte comprising an anode slime wash filtrate containing Bi and Cu and/or a recovered electrolyte is subjected to an ordinary cell for lead electrolysis using crude lead or insoluble electrodes as anodes and high purity lead as cathodes, thereby preferentially depositing and removing Bi and Cu, and the resulting liquid reduced in the amounts of Bi and Cu is recycled and used again as an electrolyte for lead electrolysis.

In the present invention, the process for electrolytic removal of Bi and Cu is not particularly limited, but is ordinarily carried out in a conventional cell for lead electrolysis under such conditions as an anode distance of 110 mm., a cell voltage of 0.12 V., a normal electrolyte temperature, and a current density of 50 to 110 $A/m^2$, when the electrolyte containing impurities has come to be consumed to 150 to 200 g/l in Pb concentration and to 20 to 50 g/l in free $H_2SiF_6$ concentration. After completion of said electrolysis, the cathodes, which have bismuth and the like impurities electrodeposited thereon, are melted together with lead bullion material, re-cast into anodes for lead electrolysis, and thus reused for lead electrolysis.

On the other hand, the slime filtrate and/or the recovered electrolyte are purified to a liquid containing several mg/l of bismuth, which is then recycled and reused for lead electrolysis. Heretofore, the washing of anode slimes have not sufficiently been effected for such fear as the dissolving-out of bismuth into the washing liquid. Thus, the adoption of the above-mentioned procedure results in such advantages that not only the said fear can be excluded but also hexafluorosilicic acid can be recovered.

Figure 4:
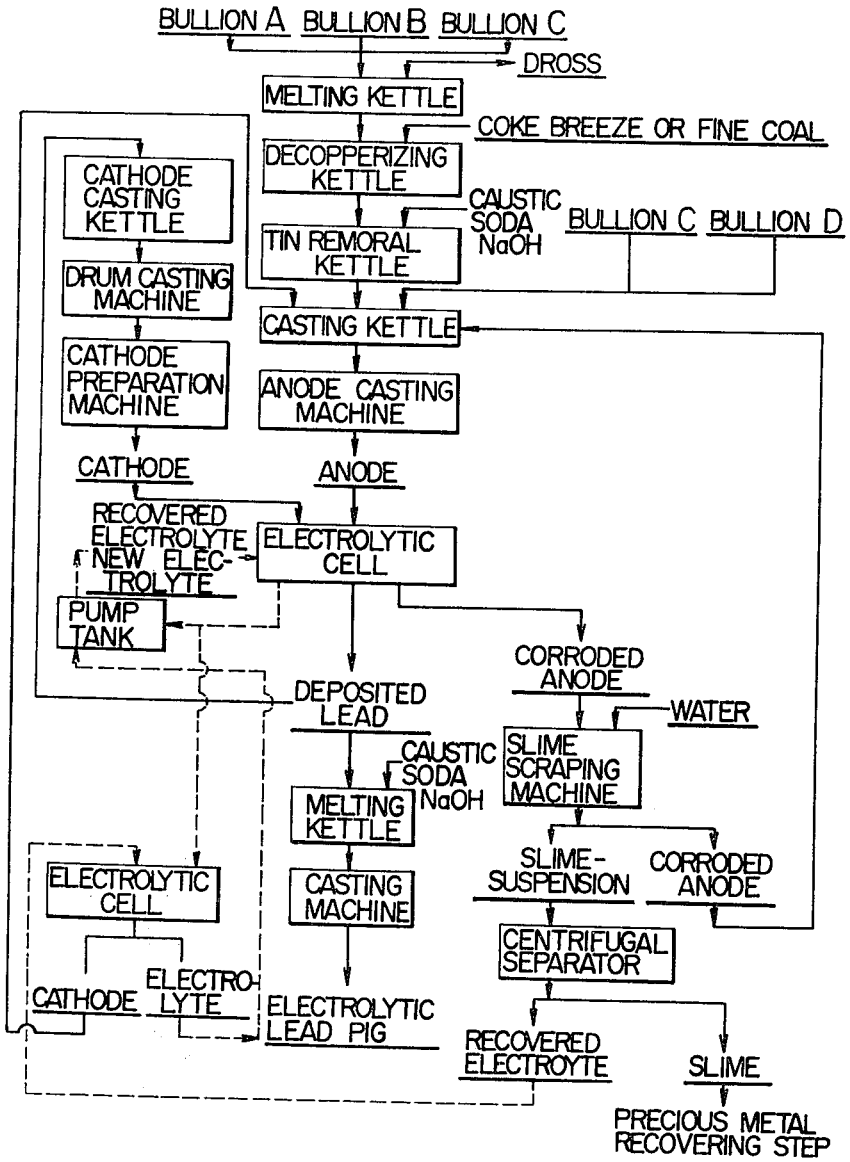
FIG. 4 is a flow sheet of the present method.

A preferred embodiment for commercial practice of the present method is explained below. FIG. 4 is a flow sheet showing the said embodiment.

Among several kinds of smelted lead bullion materials different in composition which have been obtained by smelting various concentrated lead ores according to ordinary procedures, those which are particularly high in content of Cu and Sn are blended together. The resulting mixture is heated to 520°C. in a melting kettle, and the melt surface is stirred to float up the dross, which is then removed by means of a grab crane. Subsequently, the mixture is gradually lowered in temperature to 400°C., if necessary charged with coke breeze or fine coal, and oxidized with stirring, and the oxidized Cu is removed as dross, whereby the content of Cu in the mixture becomes less than 0.1 wt %. The mixture is then melted, if necessary together with a lead bullion material containing less than 0.1 wt % of each of Cu and Sn, and then subjected to the so-called Harris process to remove Sn, As and Zn as oxides. The mixture is further blended with a lead bullion material relatively high in grade to form an anode lead material containing 0.8 to 1.3 wt % of Sb, less than 0.1 wt % of As, less than 0.6 wt % of Bi and less than 0.1 wt % of Cu, and having a lead purity of about 98 %. This lead material is transferred to a casting kettle, and cast at a temperature of 340° to 350°C. into an anode plate material having a thickness of 25 to 35 mm. and a desired size. In this case, the lead material is cast through a casting trough equipped with buffle plates having many openings, which plates are located at the melt inlet and in the way from the casting kettle, and the resulting cast sheet is subjected in a turn table-type casting machine to first to third water-spraying cooling treatments among which the first and second cooling treatments are applied to the melt surface while the third cooling treatment is applied to the back of the mold to prevent the bending of the resulting anode plate material. The casting procedure adopted in the above-mentioned casting operation is disclosed in U.S. patent application Ser. No. 442,575, Canadian Patent Application No. 192251 or Australian Patent Application No. 65678/74.

On the other hand, high purity lead prepared by refining electrodeposited lead is subjected to drum casting to form an endless sheet of about 1 mm. in thickness which has been so treated as to form curved portions therein according to the process disclosed in U.S. patent application Ser. No. 443,636, Canadian Patent Application No. 192811 or Australian Patent Application No. 65829/74. The thus formed sheet was cut to a desired size and then pressed to prepare cathode plates having strain-absorbing portions.

The cathode and anode plates are alternately suspended in an electrolytic cell, and electrolysis is effected at a current density of 110 to 130 A/m$^2$ in an aqueous solution containing 52 to 61 g/l of free hexafluorosilicic acid and 236 to 270 g/l of lead hexafluorosilicate and incorporated with glue and pulp waste liquor as additives. The anode exchange cycle is 8 to 10 days depending on the thickness of the anode plate, and the cathodes are taken up every 4 days. The anodes, which have completed the electrolysis, are sufficiently washed with water to separate them into stripped slimes and a wash filtrate, and are then returned to the original casting kettle and used for preparation of fresh anodes. The slimes are sent to a step for recovery of noble metals contained therein, while the wash filtrate (recovered liquid) is transferred, if necessary together with an electrolyte, to a purification electrolytic cell, and purified therein by applying an electric current to insoluble anodes or crude lead anodes and refined lead cathodes to electrodeposit on the cathodes the Bi and Cu contained in the filtrate. The cathodes are returned to the original casting kettle and cast into anodes for lead electrolysis, while the purified wash filtrate (the electrolyte in the drawing) is returned to the electrolytic cell. By the above-mentioned purification, the electrolyte comes to contain such reduced amounts of impurities as 0.002 to 0.005 g/l of Bi, 0.0005 to 0.002 g/l of Cu, 0.001 to 0.002 g/l of As and 0.13 to 0.20 g/l of Sb, and thus the electrodeposited lead is scarcely contaminated with said metals.

The electrodeposited lead is washed with water and then refined according to the so-called Harris process at a temperature of 400° to 420°C. in the presence of a proper amount of caustic soda to give lead having a purity of 99.999 % or more.

The present invention is illustrated in detail below with reference to examples.

EXAMPLE 1

In an electrolytic cell of the aforesaid size, that is, 130 cm. in width, 5 m. in length and 150 cm. in depth, which was larger than that used in the conventional Betts process, 42 anode plates and 43 cathode plates were alternately suspended at equal intervals (anode center distance 110 mm.). The anode plates were 100 cm. in width, 115 cm. in length, 35 mm. in thickness and 2 mm. in average curved degree, and had such composition as 97.9 wt % of lead, 1.10 wt % of Sb, 0.02 wt % of Sn, 0.02 wt % of Cu, 0.47 wt % of Bi, 0.01 wt % of As and the balance of other metals. The cathode plates were 108 cm. in width, 119 cm. in length and 0.8 mm. in thickness which had been cut from a pure lead endless sheet having hill-like curved portions at the width-wise central portions thereof and had been pressed so that the deviation degree of each cathode plate from the cathode beam became less than 5 mm. As the electrolyte was used a spent electrolyte which had been subjected to electrolysis so as to contain 55 g/l of free hexafluorosilicic acid, 250 g/l of lead hexafluorosilicate, 0.003 g/l of Bi, 0.001 g/l of Cu, 0.001 g/l of As and 0.16 g/l of Sb. Using the above-mentioned anode and cathode plates and electrolyte, electrolysis was initiated in the aforesaid cell under the conditions of a current density of 114 A/m$^2$ and an electrolyte temperature of 35°C. The electrolysis was conducted for 4 days without any injury at a bath voltage of 0.44 V., whereby electrodeposited lead containing less than 0.0001 wt % of Sb, 0.0018 wt % of Sn, 0.0001 wt % of Cu, 0.0001 wt % of Bi, less than 0.0001 wt % of As and less than 0.0001 wt % of Zn and having a purity of 99.99 % was obtained with a current efficiency of 97.39 %. The electrodeposited lead was then subjected to the Harris process to obtain refined lead having a purity of 99.999 % (containing less than 0.0001 wt % of Sb, less than 0.0001 wt % of Sb, less than 0.0001 wt % of Sn, 0.0001 wt % of Cu, 0.0001 wt % of Bi, less than 0.0001 wt % of As and less than 0.0001 wt % of Zn). In this case, the (Sb + As)/Bi ratio in the anode composition was 2.34.

EXAMPLES 2 to 5

Example 1 was repeated, except that the anode composition and the current density were varied as shown in Table 1. As the result, the current efficiency, the electrolytic bath voltage, and the analytical values of electrodeposited lead and refined lead were as set forth in Table 1.

CONTROL EXAMPLES 1 and 2

Example 1 was repeated, except that the anode plates contained 2.45 wt % of Sb, 0.14 wt % of Cu, 1.32 wt % of Bi and 0.03 wt % of As, as shown in Table 1, and thus the (Sb + As)/Bi ratio in the anode composition was 1.88 (Control Example 1), and that the anode plates had an average curved degree of 6 mm. and the cathode plates had deviated by at most 20 mm. from the cathode beams (Control Example 2).

In Control Example 1, the purity of the refined lead product could not reach 99.999 %, and in Control Example 2, the current efficiency was low and the purity of the refined lead product could not reach 99.999 % despite the fact that the anode composition was relatively favorable.

Table 1

| | Current density (A/M²) | Current efficiency (%) | Bath voltage (V) | Anode and Product | Analytical values (%) Pb | Sb | Sn | Cu | Bi | As | Zn |
|---|---|---|---|---|---|---|---|---|---|---|---|
| | | | | Anode | 98.2 | 1.20 | 0.01 | 0.02 | 0.36 | <0.01 | — |
| Example 2 | 110 | 97.82 | 0.42 | Deposited lead | 99.99 | 0.0001 | 0.0028 | 0.0004 | 0.0003 | 0.0002 | <0.0001 |
| | | | | Refined lead | 99.999 | 0.0001 | <0.0001 | 0.0001 | 0.0002 | 0.0001 | <0.0001 |
| | | | | Anode | 97.8 | 1.29 | 0.01 | 0.01 | 0.50 | 0.01 | — |
| Example 3 | 121 | 94.23 | 0.57 | Deposited lead | 99.99 | 0.0020 | 0.0004 | <0.0001 | 0.0001 | <0.0001 | <0.0001 |
| | | | | Refined lead | 99.999 | 0.0001 | <0.0001 | 0.0001 | 0.0002 | <0.0001 | <0.0001 |
| | | | | Anode | 98.2 | 1.10 | 0.01 | 0.02 | 0.41 | 0.01 | — |
| Example 4 | 112 | 97.02 | 0.55 | Deposited lead | 99.99 | 0.0006 | 0.0020 | <0.0001 | 0.0001 | <0.0001 | <0.0001 |
| | | | | Refined lead | 99.999 | 0.0001 | <0.0001 | <0.0001 | 0.0001 | <0.0001 | <0.0001 |
| | | | | Anode | 97.4 | 1.29 | 0.05 | 0.04 | 0.5 | 0.08 | — |
| Example 5 | 116 | 96.34 | 0.42 | Deposited lead | 99.99 | 0.0001 | 0.0038 | 0.0002 | 0.0003 | <0.0001 | <0.0001 |
| | | | | Refined lead | 99.999 | 0.0002 | <0.0001 | 0.0001 | 0.0001 | <0.0001 | <0.0001 |
| Control | | | | Anode | 95.11 | 2.45 | 0.05 | 0.14 | 1.32 | 0.03 | — |
| Example 1 | 120 | 96.11 | 0.50 | Deposited lead | 99.95 | 0.0023 | 0.0053 | 0.0003 | 0.0006 | <0.0001 | <0.0001 |
| | | | | Refined lead | 99.996 | 0.0001 | <0.0001 | 0.0002 | 0.0005 | <0.0001 | <0.0001 |
| Control | | | | Anode | 97.27 | 1.60 | 0.17 | 0.025 | 0.67 | 0.085 | — |
| Example 2 | 122 | 84.95 | 0.40 | Deposited lead | 99.96 | 0.0020 | 0.005 | 0.0003 | 0.0009 | <0.0001 | <0.0001 |
| | | | | Refined lead | 99.997 | <0.0001 | <0.0001 | 0.0004 | 0.0004 | <0.0001 | <0.0001 |

What is claimed is:

1. In a method for the electrolytical production of lead according to the Betts process, the improvement comprising using anodes of crude lead, containing as impurities 0.8 to 1.3% by weight of antimony, 0.6% by weight or less of bismuth, 0.1% by weight or less of copper, 0.05% by weight or less of tin, and arsenic, the ratio of the sum of the contents of antimony and arsenic to the content of bismuth being 2.0 or more, whereby there is produced electrolytically deposited lead which is feasible for being refined into a purity of 99.999% or more in the Harris process.

2. The improvement according to claim 1, wherein the electrolytical production of lead according to the Betts process is effected in an electrolytic cell of about 800 to 130 cm. in width, about 3 to 5 m. in length and about 100 to 150 cm. in depth, using cathode and anode plates suitable for the size of the cell, the average curved degree of said cathode plates being 5 mm. or less while that of said anode plates being less than 3 mm. or less.

3. The improvement according to claim 2, wherein the cathode plates are high purity lead plates having many surface wrinkles capable of absorbing residual strain which have been prepared by casting molten pure lead into an endless sheet on a rotary drum and pressing and cutting the resulting sheet, said endless sheet having at the width-wise central portions in the length-wise direction hill-like curves having a width of one-third to one-fourth of the width of the sheet and a height of 1/50 to 1/100 of the width of the sheet.

4. The improved process according to claim 1 further comprising electrolyzing by the use of anodes composed of crude lead and cathodes composed of high purity lead, an electrolyte comprising spent electrolyte of the Betts process or a washing filtrate of the anode slime produced in the Betts process to remove bismuth and copper contained therein and recycling the resultant electrolyte to the Betts process.

5. The improvement according to claim 4, wherein the electrolysis for removal of bismuth and copper is effected at room temperature at a current density of 50–110 A/m² and wherein the electrolyte to be electrolyzed contains 150–200 g/l of Pb and 20–50 g/l of free hexafluorosilicic acid.

* * * * *